US006663480B2

(12) United States Patent
Jeong et al.

(10) Patent No.: US 6,663,480 B2
(45) Date of Patent: Dec. 16, 2003

(54) POLISHING PAD FOR SEMICONDUCTOR AND OPTICAL PARTS, AND METHOD FOR MANUFACTURING THE SAME

(75) Inventors: Hae-Do Jeong, 609-323, SK Apartment 110-2005, Bu-gok 3 dong, Keum-jung gu, Pusan (KR); Ho-Sik Lee, Daejeon (KR); Ho-Youn Kim, Pusan (KR); Chul-Woo Nam, Keoung-gi do (KR); Sang-Ick Lee, Ichun Keoung-gi do (KR); Jae-Hong Kim, Keoung-gi do (KR)

(73) Assignee: Hae-Do Jeong, Pusan (KR)

( * ) Notice: Subject to any disclaimer, the term of this patent is extended or adjusted under 35 U.S.C. 154(b) by 0 days.

(21) Appl. No.: 09/878,213

(22) Filed: Jun. 12, 2001

(65) Prior Publication Data

US 2002/0004365 A1 Jan. 10, 2002

(30) Foreign Application Priority Data

Jun. 12, 2000 (KR) ..... 2000-32193

(51) Int. Cl.[7] ..... B24D 11/00

(52) U.S. Cl. ..... 451/526; 451/550; 451/533

(58) Field of Search ..... 451/526, 535, 451/533, 921, 527, 550

(56) References Cited

U.S. PATENT DOCUMENTS

| | | | | |
|---|---|---|---|---|
| 5,989,111 A | * | 11/1999 | Lamphere et al. | 451/526 |
| 6,217,432 B1 | * | 4/2001 | Woo | 451/534 |
| 6,319,108 B1 | * | 11/2001 | Adefris et al. | 451/533 |
| 6,390,890 B1 | * | 5/2002 | Molnar | 451/41 |
| 6,454,644 B1 | * | 9/2002 | Miyazaki et al. | 451/526 |

* cited by examiner

*Primary Examiner*—Lee D. Wilson
(74) *Attorney, Agent, or Firm*—Bacon & Thomas

(57) ABSTRACT

The present invention relates to a polishing pad for the chemical mechanical polishing (CMP). According to the present invention, there is provided a chemical mechanical polishing pad for polishing a semiconductor wafer with chemicals containing predetermined components supplied between the semiconductor wafer and the polishing pad, comprising a base layer; and an abrasive layer which contains polishing abrasives capsulated with a material soluble in the chemicals and is formed to have a constant thickness on the top surface of the base layer. The capsulated polishing abrasives become free abrasives in the chemicals supplied upon polishing, and take part in the polishing. Capsulating the polishing abrasives can be performed by granulization or spraying. According to the polishing pad of the present invention, planarization polishing can be performed as whole. In addition, since a small amount of chemicals are used, it is advantageous in the economic and environmental aspects.

11 Claims, 3 Drawing Sheets

POLISHING PAD FOR SEMICONDUCTOR AND OPTICAL PARTS, AND METHOD FOR MANUFACTURING THE SAME

FIELD OF THE INVENTION

The present invention relates to a polishing pad for polishing a semiconductor wafer or optical parts, and method for manufacturing the same, more particularly to a polishing pad which can efficiently polish with a minimum amount of chemicals by capsulating polishing abrasives, and a method for manufacturing the same.

BACKGROUND OF THE INVENTION

A process for forming a metal wiring, an insulating film and an interlayer wiring by various methods such as CVD, PVD and etching is one of the basic processes for manufacturing the semiconductor device. After each process is completed between such processes, a planarization process is performed for planarizing the processed surface.

Since the critical dimension (CD) of each conductive pattern becomes smaller as the semiconductor device is integrated as a multiplayer structure, the planarization process becomes an essential process. The planarization process is a broad concept including the enhancement of the planarity of the surface to be processed or the uniform removal of the thin film surface. However, especially, in that the planarization process is performed by selectively removing the projected portions in the irregular surface generated after insulating process or sputtering process for interlayer wiring, or in that the planarization process is performed by simultaneously and uniformly removing different materials of the metal wiring and the insulating film such as oxide and nitride, the planarization process is important in the largely integrated semiconductor device. In addition, it is meaningful in that the focal depth of light source can be ensured in an exposure process by virtue of the planarization process.

Up to now, in order to perform the planarization process, a variety of processes such as SOG (Spin on Glass) and etch-back have been performed. However, recently, to this ends, chemical mechanical polishing (CMP; hereinafter, it is referred to as CMP), in which mechanical polishing and chemical polishing are simultaneously performed, is widely performed. The chemical mechanical polishing is widely used in that the advantages of the existing mechanical polishing and chemical polishing can be simultaneously obtained.

Hereinafter, a typical CMP apparatus and its principle will be explained with reference to FIG. 1.

As shown in FIG. 1, on the top surface of a rotating table 2, a polishing pad 4 having a flat top surface for polishing is adhered. Over the top of the polishing pad 4, a wafer carrier 8 to which a wafer 6 is adhered is installed to rub with the polishing pad 4. The wafer carrier 8 is in close contact with the polishing pad 4 by constant force F so that both rotation and oscillation motions are performed. These motions polish and planarize the surface of the wafer 6 in combination with the rotation motion of the table 2.

In the polishing process, by a slurry supplying mechanism 12, slurries for polishing are supplied between the wafer 6 and the polishing pad 4. In addition, after polishing of more than a constant duration, in order to secure the polishing properties of the polishing pad 4, a conditioner 10 performs a conditioning function to the top surface of pad 4.

The slurries supplied during the polishing process are a medium for transferring polishing abrasives and chemicals from or to the surface of the wafer to be processed. In the slurries, polishing abrasives are suspended in acidic or alkaline chemicals in accordance with the polishing target type. The polishing abrasives have the grain size of 100–1000 Å and the hardness similar to that of the wafer so that mechanical removing action can be performed, and generally occupy about 1–30 wt. % in the slurry. Fumed silica, colloidal silica or alumina is used as the polishing abrasives.

Generally, the polishing pad 4 formed of polyurethane foam is widely used. As shown in FIG. 2, the polishing pad 4 of polyurethane foam has a plurality of pores 4*a* and pore walls 4*b* contacted with the wafer to be polished. The pores 4*a* serves to supply the slurries between the pore walls 4*b* and the wafer 6 while retaining the supplied slurries in their interiors.

Generally, in the polishing pad, different properties are required according to the wafer type to be planarized. For example, a Si wafer should be processed with the surface roughness of 1 n m and corrected with the entire thickness variation of 1 m. Thus, it is important that the wafer should be simultaneously and uniformly processed. To this end, a soft pad following the entire shape of the wafer is generally used. That is, in case of the soft pad, since its deformation is relatively large, the entire wafer can be uniformly processed when the soft pad is pressed against the wafer.

On the other hand, in case of a device wafer on which conductive or nonconducting patterns are formed, since there are irregularities on its surface, a hard pad is generally used in order to make shape selectivity higher. When the hard pad is used, the shape selectivity becomes higher. However, since the entire deformation of the hard pad is small, it is difficult to uniformly correct the entire wafer.

Therefore, generally, in order to simultaneously realize the two parameters, the polishing pad employs a two-layer structure having upper and lower portions. That is, the upper portion is a hard pad portion for increasing the shape selectivity and the lower portion is a soft pad portion for correcting the entire uniformity.

The above existing polishing pad for CMP encountered the following problems.

First, in case of use of a polishing pad having pores, since particles of the processed target or polishing abrasives are cohered in the pores, the glazing phenomenon is generated in the pores. Once the glazing phenomenon occurs in the pores, the pores cannot smoothly perform its own function of supplying slurries between the pore walls and the wafer. Therefore, since the slurries are not uniformly supplied or are blocked not to be supplied, the uniform process cannot be expected. In continuously processing wafers in which semiconductor devices are integrated, the glazing phenomenon has a negative impact on the process repeatability and stability.

During the processing of the wafer by means of the polishing pad, the slurries should be continuously supplied. Free abrasives in the liquid slurries perform mechanical polishing. However, due to the free motion of the free abrasives, the wafer may be locally excessively processed. Then, according to the pattern shape, material, density and so forth of the wafer surface, different surface defects such as dishing or erosion are generated.

In addition, in a general CMP, the only 30–40% of slurries to be supplied take part in the surface processing in order to polish the wafer. Since the slurries should continuously be supplied during the polishing process, in order to actually use the only 30–40% of slurries, the remaining 60–70% slurries should be unnecessarily wasted. That is, there is a problem in that the wasted slurries are much more than the portion of the slurries to be actually used in the polishing. Thus, since the expensive slurries are excessively supplied, the production costs of semiconductor devices rise and the disposal costs of waste slurries increase. Of course, there is a further problem in that the increase of waste slurries has a negative impact on the environment.

SUMMARY OF THE INVENTION

The present invention is contemplated to solve the above problems. The object of the present invention is to provide a polishing pad that can continuously and stably polish a wafer by eliminating the glazing phenomenon in the polishing pad.

Another object of the present invention is to provide a polishing pad that can maximize polishing effects with a minimum amount of slurries upon polishing of a semiconductor wafer or optical parts.

A further object the present invention is to provide a polishing pad that is economically advantageous in view of the production and disposal costs of slurries by minimizing the using amount of slurries.

A still further object the present invention is to provide a polishing pad that can minimize possible environmental contamination by providing a process of a semiconductor with the polishing pad compatible with the environment.

According to the present invention for achieving the objects, there is provided a chemical mechanical polishing pad for polishing a semiconductor wafer with chemicals containing predetermined components supplied between the semiconductor wafer and the polishing pad, comprising a base layer; and an abrasive layer which contains polishing abrasives capsulated with a material soluble in the chemicals and is formed to have a constant thickness on the top surface of the base layer.

The base layer may comprise a lower soft layer and a hard layer formed on the top of the soft layer. In addition, the base layer may comprise a polyurethane foam layer, and may be formed as a soft layer or hard layer by adjusting foam density.

The abrasive layer containing the capsulated polishing abrasives may be applied, together with material to be swelled in the chemicals, to the top of the base layer.

According to the present invention, there is provided a method for manufacturing a chemical mechanical polishing pad for polishing a semiconductor wafer with chemicals containing predetermined components supplied between the semiconductor wafer and the polishing pad, comprising the steps of coating and capsulating outer surfaces of the polishing abrasives with a first binder soluble in the chemicals; applying the capsulated polishing abrasives to the top of a base layer so as to have a constant thickness; and curing the applied abrasive layer.

According to one embodiment of the capsulating step, the step further comprises the steps of uniformly dispersing the polishing abrasives in a mixed solution of the first binder and a solvent solving the first binder, and spraying the dispersed solution and evaporating the solvent. That is, a spraying method is used in the capsulating step.

According to another embodiment of the capsulating step, the step is performed by a granulization method.

The applying step may comprise the steps of gelling the capsulated abrasives by use of a second binder swelled in the chemicals supplied upon polishing, and applying it to the top of the base layer.

Further, the applying step may comprise the steps of gelling the capsulated abrasives by a mixture of an initiator to be reacted with light having a specific wave length and the second binder to be swelled in the chemicals supplied upon polishing, and applying it on the base layer; and the curing step may comprise a step of irradiating light having a specific wavelength by which the initiator is cured.

DETAILED DESCRIPTION FOR PREFERRED EMBODIMENT

Hereinafter, a preferred embodiment of the present invention will be explained in detail with reference to the accompanying drawings.

Figure 1:
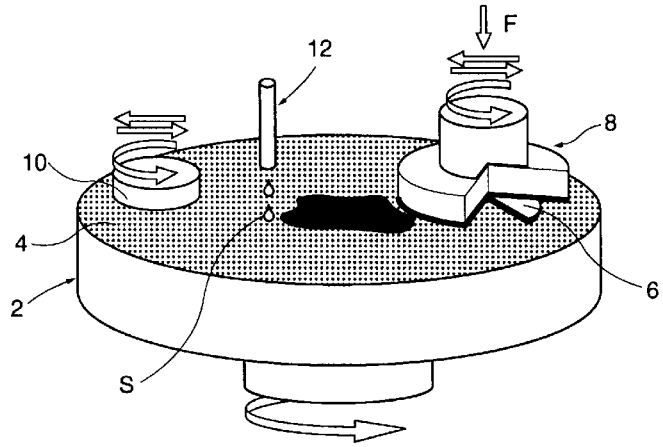
FIG. 1 is a schematic view of a general chemical mechanical polishing apparatus.
Figure 2:
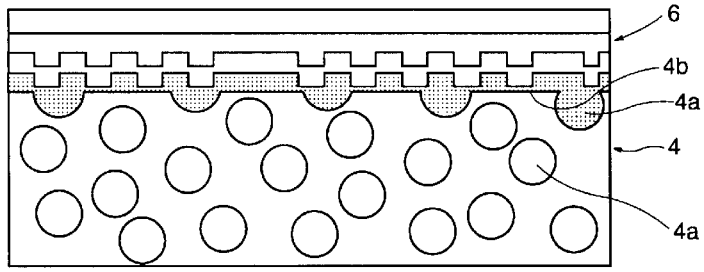
FIG. 2 is a cross-sectional view of a general polishing pad.
Figure 3:
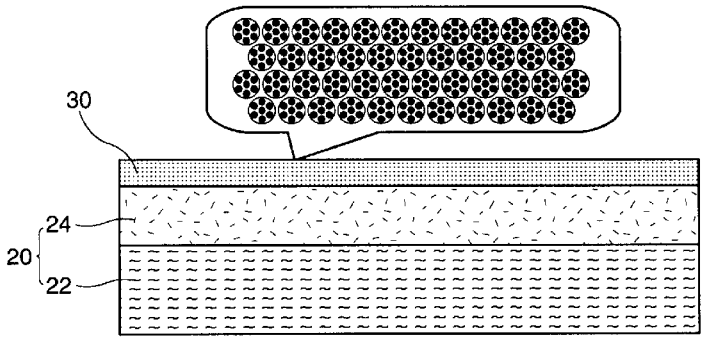
FIG. 3 is a cross-sectional view of the polishing pad of the present invention.

FIG. 3 shows the sectional structure of a polishing pad of the present invention. As shown in the figure, the polishing pad comprises a base layer 20 and an abrasive layer 30. The base layer 20 serves as a base material on which the abrasive layer 30 is placed.

It is preferable that the base layer 20 comprise a lower soft layer 22 and a hard layer 24 formed on the soft layer. As described above in connection with the prior art, the soft and hard layers 22 and 24 are provided for the entire and local planarization, respectively.

The soft and hard layers 22 and 24 can be made of polyurethane in the same way as the prior art, and can be embodied by adjusting the density and type of the polyurethane foam.

Since the constitutions of the soft and hard layers 22 and 24 are the same constitutions as the prior art, the detailed explanation thereof will be omitted.

Hereinafter, the abrasive layer 30 formed on the top of the hard layer 24 will be explained. The abrasive layer 30 may be explained as being fixed on the top surface of the hard layer 24 by capsulating polishing abrasives contained in conventional slurries.

Figure 5:
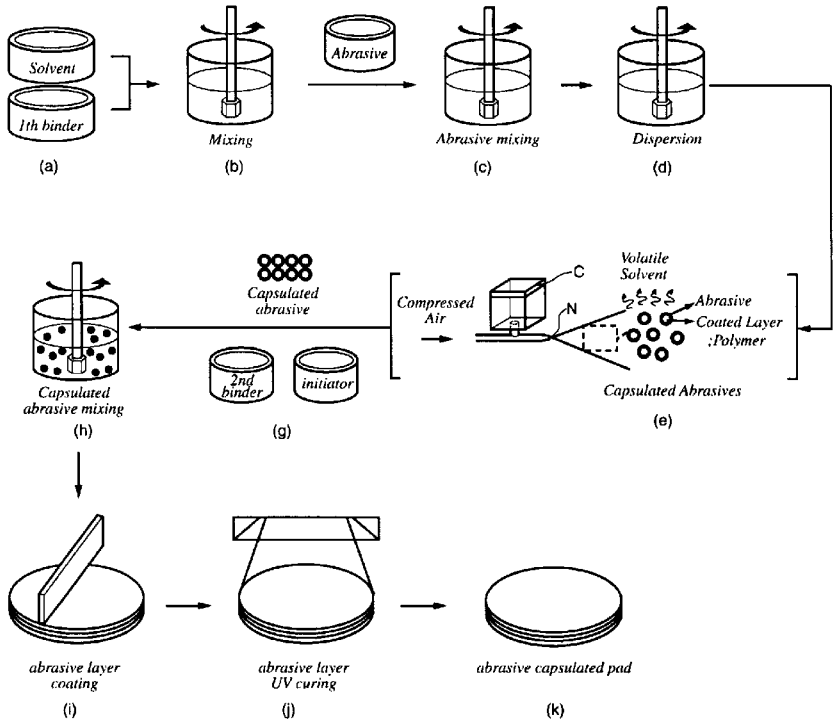
FIG. 5 is an exemplary view showing manufacturing processes of the polishing pad of the present invention.

Referring to FIG. 5, a capsulating step and function of the polishing abrasives will be explained. FIG. 5 shows processes of forming the abrasive layer 30 of the polishing pad of the present invention.

First, a first binder and a solvent are mixed (b). After polishing abrasives are added and mixed thereto (c), the mixed solution is entirely and uniformly dispersed (d). In the dispersion process, it is preferable that a high degree of dispersion technique be applied for uniform mixing and dispersion of the polishing abrasives. As will be described below, the uniform mixing and dispersion of polishing abrasives are important in the capsulating process of the polishing abrasives.

It is preferable that the first binder be a material soluble in chemicals supplied upon chemical mechanical polishing, such as polymer.

For example, in polishing the wafer surface, acidic chemicals are used for slurries for metals, and alkaline chemicals such as aqueous ammonia are used for slurries for interlayer insulating films. Any materials that can be solved in the chemicals and can make the capsulated abrasives free can be used as the first binder. Therefore, in addition to the above polymer, if they are soluble in the chemicals supplied during the polishing process, other materials may also be used.

A solvent mixed with the first binder uses a highly volatile material that can be easily volatized with only the binder left. That is, the solvent mixed with the first binder performs a function of solving the first binder and uniformly mixing the first binder and the polishing abrasives, and a function of capsulating the polishing abrasives by means of its evaporation in a state that the first binder surrounds the polishing abrasives during the capsulating process to be described later.

After the first binder is uniformly dispersed in the solvent, the capsulation is performed in step (e). That is, the process of capsulating the above polishing abrasives is performed in such a manner that the first binder surrounds the exterior of polishing abrasives. Here, FIG. 5(*e*) shows one embodiment of capsulating the polishing abrasives, and explains the process of capsulating the polishing abrasives by a spraying method using pressurized air.

The solution uniformly dispersed in step (d) is put in a container C, and is sprayed through a nozzle N by using high-pressure air. When the solution in which the abrasives and the binder have been uniformly dispersed is sprayed, the solvent having a high volatility is volatized and only the capsulated abrasives capsulated with the first binder are left. FIG. 5(*d*) exemplarily shows the section of the capsulated abrasives. As shown in the figure, a coated layer of the first binder such as polymer surrounds the exteriors of the polishing abrasives.

Here, the grain size of the polishing abrasives is about 0.1–0.2 $\mu$m, and the grain size of capsules is about 50–200 $\mu$m. Each particle of polishing abrasives may be capsulated with the binder. However, in practical, several particles of the polishing abrasives are generally capsulated with the binder. By adjusting the spray velocity of high-pressure air supplied for spraying the solution and the diameter of the nozzle N, the grain size of capsulated abrasives can be regulated. That is, the higher the spray velocity is or the smaller the diameter of nozzle is, the smaller the actually sprayed grain size is. Thus, the grain size to be capsulated becomes small. Therefore, since the number of the polishing abrasives contained in one capsule is reduced, fine capsulation can be achieved.

Figure 6:
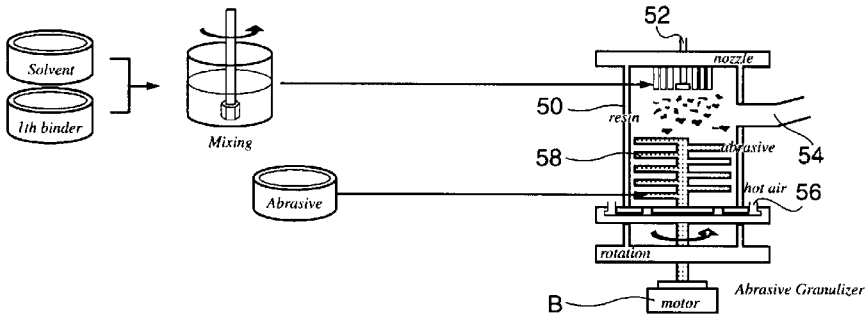
FIG. 6 is an explanatory view of another embodiment of a capsulating method of the present invention.

Next, referring to FIG. 6, another embodiment of capsulating the polishing abrasives with the first binder will be explained. In step (e) described above, the method for capsulating by means of the spraying was explained. FIG. 6 shows a capsulating process using a general granulizing. As for the capsulating method by the above granulizing, since it is actually used in other technical fields (for example, in food field), it will be schematically explained.

As shown in FIG. 6, the solution in which a solvent and the first binder are mixed is continuously supplied through a nozzle 52 positioned at the top of a chamber 50. At the lower interior of the chamber 50, hot air is introduced through an inlet 56 into the lower interior of the chamber 50. Below the lower interior of chamber 50, an impeller 58 to be rotated by a drive motor M is mounted for directing airflow in the upward direction.

Polishing abrasives are continuously or periodically supplied through an inlet 54 to the interior of the chamber 50. While the introduced, mixed solution of solvent and first binder is sprayed through the nozzle 52, it is adhered to the polishing abrasives in the interior of chamber 50. During this process, a plurality of polishing abrasives will be conglomerated and thus granulized. With the hot air supplied from the exterior, the volatile solvent is sufficiently evaporated and the first binder substantially surrounds the polishing abrasives. That is, the polishing abrasives are capsulated.

As can be seen from the above two embodiments, a variety of methods can be used for coating the first binder on the exteriors of the polishing abrasives so that the polishing abrasives are capsulated. The essentials of the capsulation are that the outer surfaces of the polishing abrasives are surrounded with the first binder by using a specific solvent. Although it is not disclosed herein, it is understood that a method for capsulating specific abrasives may be applied to the process of the present invention.

In this way, the polishing abrasives coated with the first binder (hereinafter, it is referred to as capsulated abrasives) are completed. Then, a process for applying the capsulated abrasives to the top surface of the hard layer 24 and forming the abrasive layer 30 will proceed.

In the process of FIG. 5(*g*), a second binder, an initiator and the polishing abrasives capsulated in the above process are mixed. In the process of FIG. 5(*h*), they are uniformly mixed. As will be described below, the initiator generates a curing reaction with a light component having a specific wavelength. In order to cure the abrasive layer 30 in an UV process to be described below, the initiator is added.

Here, the second binder is made of materials that can be swelled in the deionized water contained in the polishing chemicals supplied between the polishing pad and the wafer. For example, it may have polyethylene oxide as a main component. The swelling in the deionized water means that the bonding force between the second binder and the capsulated abrasives becomes small and the capsulated abrasives finally become free due to friction force and polishing pressure. The second binder may incidentally contain additives for securing surface hardness and toughness of the abrasive layer 30 to be polished.

The swelling of the second binder in the chemicals means that the second binder substantially has an affinity for the chemicals supplied upon polishing. Generally, when the second binder has an affinity for a certain material, the second binder absorbs the material and is swelled. That is, this means that the bonding force between the second binder and the capsulated abrasives becomes weak and the second binder can be automatically dressed due to any friction force or the like.

In addition, although it has been described in the above embodiment that the second binder is swelled in the deionized water. However, any materials that have an affinity for a specific component of the second binder and can be swelled in the component may be used as the second binder.

Since any chemical solutions basically contain water, there are a number of materials to be used as the second binder. This means that any materials that have an affinity for the water and can be swelled in the water may be used as the second binder.

After the capsulated polishing abrasives are gelled by the second binder, they form the abrasive layer 30 on the top surface of the hard layer 24. That is, the abrasive layer having a constant thickness is coated on the top surface of the hard layer (step (i)). Next, the process of curing the applied abrasive layer is performed.

In the above embodiment, the abrasive layer 30 is cured by the UV curing in step (j). The curing by the irradiation of the UV is because the initiator mixed with the second binder is chemically reacted with the wavelength component of the ultra-violet light and is then cured.

In addition to the curing method of irradiating the ultra-violet light as described above, it is understood that the abrasive layer 30 coated in a gel state may be cured by other methods. In the present embodiment, after mixing the second binder and the initiator, the abrasive layer is applied in step (i). Thus, as a condition for curing the initiator, ultra-violet light having a specific wavelength component is irradiated.

It should be understood that other curing methods of applying predetermined heat or irradiating light having a wavelength range excluding ultra-violet light may be used.

When the coated abrasive layer is cured by irradiating ultra-violet light in step (j), the abrasive layer 30 is completed in step (k).

Hereinafter, the polishing operation by the polishing pad having the above abrasive layer 30 will be explained.

Figure 4:
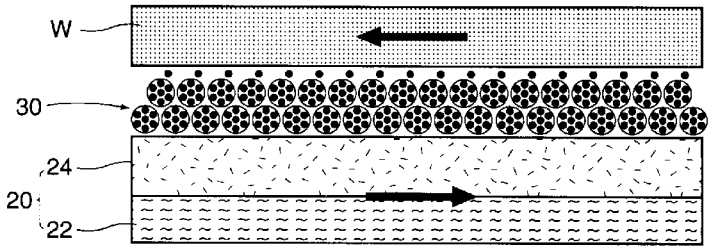
FIG. 4 is a cross-sectional view exemplifying a state of the polishing pad of the present invention upon polishing.

FIG. 4 exemplifies the polishing process under the condition that the wafer (for example, a Si wafer) to be polished and the polishing pad of the present invention are in contact with each other. The applied abrasive layer 30 formed on the top surface of the hard layer 24 of the polishing pad has a constant surface hardness, toughness and thickness.

The polishing pad and the wafer, which are in contact with each other, relatively move with respect to each other. For example, the polishing pad performs a rotation motion, and the wafer W performs simultaneously both a rotation motion and a constant oscillation.

During the polishing of the wafer W, chemicals having predetermined components are continuously supplied between the abrasive layer 30 of the polishing pad and the wafer W for generating a chemical reaction upon polishing. Acidic or alkaline chemicals are selectively supplied according to the type of a target to be polished (for example, whether the target is a Si wafer or a wafer having certain patterns).

When the chemicals are supplied and the first binder is solved by the component contained in the chemicals, the polishing abrasives are emitted from the capsulated polishing abrasives in the uppermost portion of the abrasive layer 30 and take part in the polishing. While the polishing abrasives on the uppermost portion of the abrasive layer 30 are emitted and the polishing is performed, the second binder is swelled in the deionized water contained in the supplied chemicals. Here, the bonding force of the second binder is considerably reduced. Thus, the bonding force will be extinct from the surface layer by the frictional force generated from the second binder and the wafer contacted upon processing.

Therefore, when the chemicals having predetermined components supplied upon polishing solve the first binder, the polishing abrasives are emitted and take part in the polishing. At the same time, the second binder is swelled and removed by the frictional force with the wafer so that the polishing abrasives take part in the polishing again. This phenomenon propagates toward the lower layer as the polishing processes from the surface layer.

In the polishing process of the present invention, the action of the abrasive layer is summarized as follows.

According to the present invention, upon polishing a target wafer, since the first binder surrounding the peripheries of the capsulated abrasives is solved by the chemicals and the abrasives are emitted, they will entirely and uniformly act on the wafer to be polished. In addition, since the concept of the abrasive layer 30 is introduced instead of the concept of the pores, the polishing abrasives or particles of the target to be processed can be prevented from blocking the pores. Thus, the glazing phenomenon in the pores is not substantially generated.

In the abrasive layer 30 of the present invention, the capsulated abrasives fixed by the second binder can be considered as substantially fixed abrasives. When the binder component of the fixed abrasives is solved, the fixed abrasives become free abrasives. Therefore, the free abrasives can be uniformly provided as a whole.

In addition, according to the present invention, since the polishing abrasives perform uniform polishing on the wafer surface as a whole, the actually supplied amount of chemicals can be minimized. That is, while the fixed abrasives are converted into free abrasives by the supplied chemicals, most of the free abrasives take part in the effective polishing. Thus, only the amount of chemicals required for the actually effective polishing can be supplied. Therefore, the actually used amount of chemicals can be minimized and uniform polishing can be performed.

According to the polishing pad of the present invention as described above, there are advantages as follows:

When the chemicals are supplied, the abrasives fixed in the abrasive layer become the free abrasives and are contacted with the polished surface of the wafer. Thus, since the wafer to be processed is entirely and uniformly exposed to the free abrasives, entirely uniform polishing can be performed. That is, the function of a high degree of planarization can be performed. In addition, surface defects such as dishing or erosion, which have generated irregular polishing due to the free motion of the free abrasives in the conventional polishing method, can be removed.

Upon polishing, the polishing abrasives uniformly disposed in the abrasive layer take part in the polishing as a whole. Thus, it can be expected to obtain maximum polishing effects with a minimum amount of supplied slurries. A minimum amount of supplied slurries has considerable advantages in the economic and environmental aspects.

As described above, the basic technical spirit of the present invention is to capsulate the polishing abrasives and to adhere them to the top of the hard layer of the polishing pad in order to form the abrasive layer. It will be understood that a person having ordinary skill in the art can make various modifications to the present invention within the spirit and scope of the invention. Therefore, the present invention should be construed by the appended claims.

What is claimed is:

1. A chemical mechanical polishing pad for polishing a semiconductor wafer with chemicals containing predetermined components supplied between said semiconductor wafer and said polishing pad, comprising:

a base layer; and an abrasive layer which contains polishing abrasives capsulated with a first binder material soluble in said chemicals and formed to have a constant thickness on a top surface of said base layer with a second binder swellable in said chemicals.

2. The chemical mechanical polishing pad as claimed in claim 1, wherein said base layer comprises a lower soft layer and a hard layer formed on the top of said soft layer.

3. The chemical mechanical polishing pad as claimed in claim 2 wherein the abrasives have a grain size of from 0.1–0.2 $\mu$m and the capsulated abrasives have a particle size of 50–200 $\mu$m.

4. A chemical mechanical polishing pad as claimed in claim 3 wherein the second binder is swellable by de-ionized water.

5. A chemical mechanical polishing pad as claimed in claim 2 wherein the second binder is swellable by de-ionized water.

6. The chemical mechanical polishing pad as claimed in claim 1, wherein said base layer comprises a polyurethane foam layer.

7. The chemical mechanical polishing pad as claimed in claim 6 wherein the abrasives have a grain size of from 0.1–0.2 $\mu$m and the capsulated abrasives have a particle size of 50–200 $\mu$m.

8. A chemical mechanical polishing pad as claimed in claim 6 wherein the second binder is swellable by de-ionized water.

9. The chemical mechanical polishing pad as claimed in claim 1 wherein the abrasives have a grain size of from 0.1–0.2 $\mu$m and the capsulated abrasives have a particle size of 50–200 $\mu$m.

10. A chemical mechanical polishing pad as claimed in claim 9 wherein the second binder is swellable by de-ionized water.

11. A chemical mechanical polishing pad as claimed in claim 1 wherein the second binder is swellable by de-ionized water.

* * * * *